US006119959A

United States Patent [19]

Smith, III et al.

[11] Patent Number: 6,119,959

[45] Date of Patent: Sep. 19, 2000

[54] FUEL INJECTOR WITH CONTROLLED SPILL TO PRODUCE SPLIT INJECTION

[75] Inventors: Ralph A. Smith, III; Steven Y. Tian, both of Bloomington, Ill.

[73] Assignee: Caterpillar Inc., Peoria, Ill.

[21] Appl. No.: 09/247,487

[22] Filed: Feb. 10, 1999

[51] Int. Cl.[7] ..... F02M 47/02

[52] U.S. Cl. ..... 239/89; 239/91; 239/90; 239/95; 123/496; 123/501

[58] Field of Search ..... 239/88–96, 124, 239/126, 533.4; 123/299–300, 467, 496, 501

[56] References Cited

U.S. PATENT DOCUMENTS

| | | | |
|---|---|---|---|
| 2,590,575 | 3/1952 | Rogers | 239/88 |
| 5,035,221 | 7/1991 | Martin . | |
| 5,390,851 | 2/1995 | Long et al. | 239/126 |
| 5,429,309 | 7/1995 | Stockner . | |
| 5,463,996 | 11/1995 | Maley . | |
| 5,492,090 | 2/1996 | Bucker . | |
| 5,492,098 | 2/1996 | Hafner . | |
| 5,533,672 | 7/1996 | Peters | 239/88 |
| 5,535,723 | 7/1996 | Gibson . | |
| 5,551,398 | 9/1996 | Gibson . | |
| 5,566,660 | 10/1996 | Camplin . | |
| 5,628,293 | 5/1997 | Gibson . | |
| 5,655,501 | 8/1997 | Hafner . | |
| 5,673,669 | 10/1997 | Maley . | |
| 5,711,279 | 1/1998 | Green et al. | 239/96 |
| 5,730,104 | 3/1998 | Hafner | 123/300 |
| 5,779,149 | 7/1998 | Hayes, Jr. | 239/124 |
| 5,788,154 | 8/1998 | Beatty | 239/124 |
| 5,887,790 | 3/1999 | Flinn | 239/88 |
| 5,894,992 | 4/1999 | Liu et al. | 239/533.4 |

*Primary Examiner*—Andres Kashnikow
*Assistant Examiner*—Dinh Q. Nguyan
*Attorney, Agent, or Firm*—Michael McNeil

[57] ABSTRACT

An injector body defines a fuel pressurization chamber, a spill passage, a stop volume and a nozzle outlet. Positioned within the injector body is a plunger which is movable between a retracted position and an advanced position. The plunger opens the spill passage to the fuel pressurization chamber over a portion of the distance between the retracted and advanced positions. The injector body also contains a needle valve member which includes a closing hydraulic surface that is exposed to fluid pressure in the stop volume. The stop volume is pressure coupled to the spill passage.

20 Claims, 5 Drawing Sheets

IDLE CONDITION PLUNGER MOTION

IDLE CONDITION CHECK PISTON MOTION

IDLE CONDITION NEEDLE MOTION

IDLE CONDITION INJECTION PRESSURE

IDLE CONDITION STOP VOLUME PRESSURE

IDLE CONDITION INJECTION RATE

RATED CONDITION PLUNGER MOTION

RATED CONDITION CHECK PISTON MOTION

RATED CONDITION NEEDLE MOTION

RATED CONDITION INJECTION PRESSURE

RATED CONDITION STOP VOLUME PRESSURE

RATED CONDITION INJECTION RATE

FUEL INJECTOR WITH CONTROLLED SPILL TO PRODUCE SPLIT INJECTION

TECHNICAL FIELD

The present invention relates generally to fuel injection systems with fuel spillage features, and more particularly to hydraulically-actuated fuel injection systems with controlled fuel spillage to produce split injections.

BACKGROUND ART

It has long been known that noise and exhaust emissions can be reduced at various engine operating conditions by fuel injection rate shaping. This process tailors the rate at which fuel is injected during the fuel injection cycle. One method of rate shaping that has proven effective at controlling emissions at idle engine operating conditions involves the utilization of a spill control device to create a split injection.

One example using a spill control device to create a split injection is presented in U.S. Pat. No. 5,492,098 to Hafner et al. Hafner uses a spill control device to briefly lower the pressure surrounding the needle valve member during the injection event to create a split injection at idle operating conditions. In Hafner, when the plunger is moving toward its advanced position, an annulus defined by the plunger opens the fuel pressurization chamber to a spill port, which is connected to a low pressure fuel return area. This causes a drop in pressure within the fuel pressurization chamber to below valve closing pressure, which in turn creates a dramatic drop in pressure in the nozzle chamber, thus allowing the biasing spring to act against the needle valve member to briefly close the nozzle outlet. Once the annulus has passed the spill port, the fluid connection between the fuel pressurization chamber and the low pressure area is closed. This causes the pressure in the nozzle chamber to increase and the needle valve member can again act against the action of the biasing spring to open the nozzle outlet.

The Hafner method creates a short time in between the split injections, referred to as dwell time. This dwell time is a function of various geometric features including the width of the annulus and the shape of the spill port, among others. While the Hafner injector has worked well to decrease undesirable emissions at idle engine operating conditions, the maximum dwell time capability for the Hafner injector is inherently limited by the stroke of its plunger. For instance, an annulus with a larger width would increase the dwell time, but may undermine performance at a rated operating condition. For some applications there is a desire to increase the dwell time beyond the geometric constraints inherent in the Hafner fuel injector.

The present invention is directed to improving upon fuel spillage split injection devices by providing a broader range of possible dwell times.

DISCLOSURE OF THE INVENTION

An injector body defines a fuel pressurization chamber, a spill passage which is pressure coupled to a stop volume, and a nozzle outlet. Positioned within the injector body is a plunger which is movable between a retracted position and an advanced position. The plunger opens the spill passage to the fuel pressurization chamber over a portion of the distance between the retracted and advanced positions. The injector body also contains a needle valve member which includes a closing hydraulic surface that is exposed to fluid pressure in the stop volume.

BEST MODE FOR CARRYING OUT THE INVENTION

Figure 1:
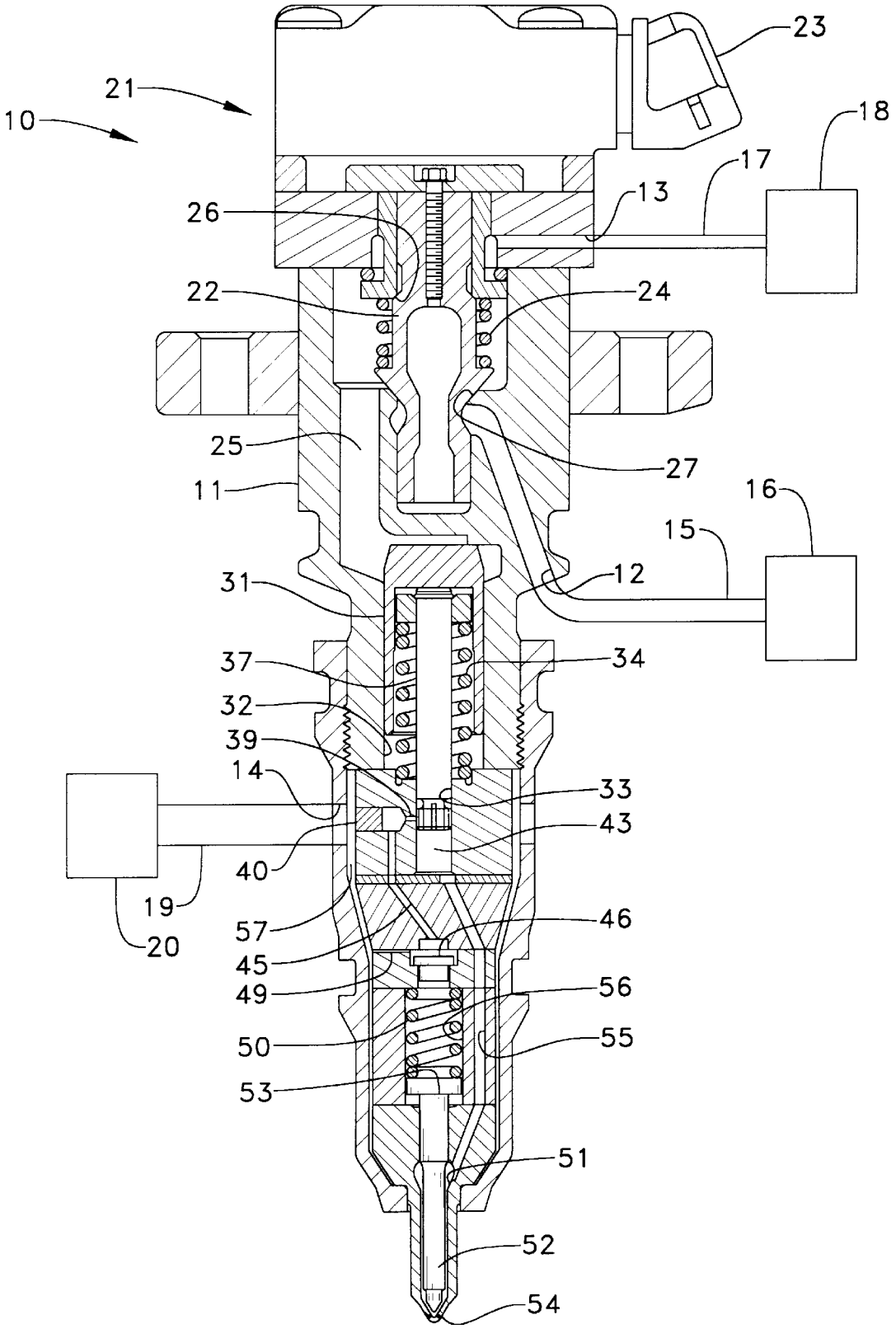
FIG. 1 is a diagrammatic side cross-section of a hydraulically-actuated fuel injector according to the preferred embodiment of the present invention.
Figure 2:
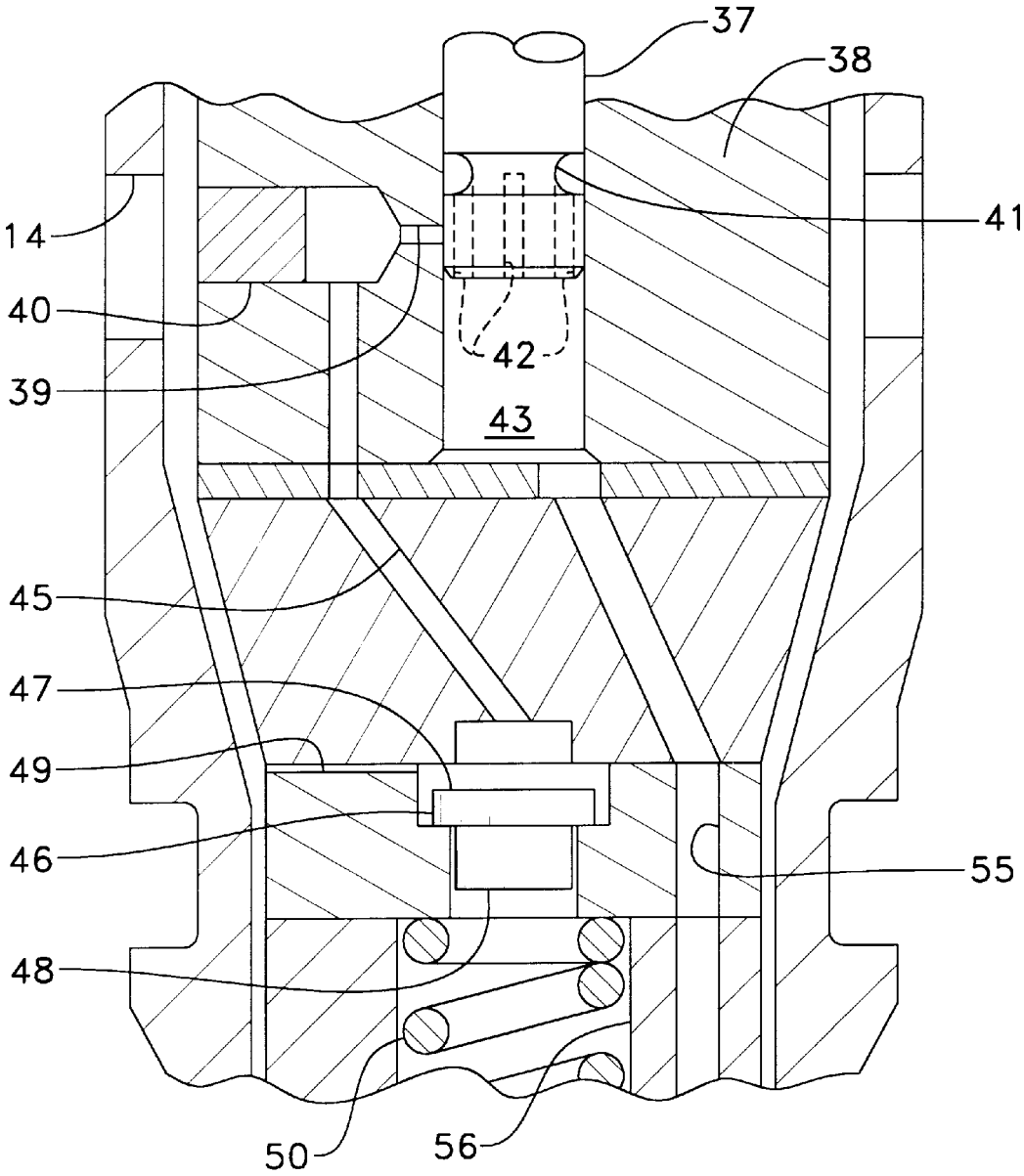
FIG. 2 is a partial diagrammatic side cross-section of the plunger portion of the hydraulically-actuated fuel injector of FIG. 1.

Referring now to FIGS. 1 and 2, there is shown a hydraulically-actuated fuel injector 10 according to the preferred embodiment of the present invention. Fuel injector 10 includes an injector body 11 which contains various components that are attached to one another in a manner well known in the art and positioned as they would be just prior to an injection event. In particular, a solenoid 21 is attached to an electronic connection 23 and is deactivated such that a control valve member 22 is biased toward a high pressure seat 27 by the action of a biasing spring 24 to close a high pressure actuation fluid inlet 12 from an actuation fluid cavity 25. When the control valve member 22 is seated as shown, the actuation fluid within the actuation fluid cavity 25 can exit fuel injector 10 through a low pressure actuation fluid drain 13. Exiting actuation fluid then flows into a drain reservoir 18 via a drain passage 17. When solenoid 21 is activated, control valve member 22 is lifted against the action of biasing spring 24, to move from the high pressure seat 27 to a low pressure seat 26. When control valve member 22 is at the low pressure seat 26, actuation fluid cavity 25 is closed to actuation fluid drain 13 and opened to high pressure actuation fluid inlet 12. High pressure actuation fluid can then flow in high pressure actuation fluid inlet 12 from a source 16 via a high pressure actuation fluid supply passage 15. This high pressure fluid flows into actuation fluid cavity 25 to act on the top of an intensifier piston 31.

Because of the lower pressure in the actuation fluid cavity 25 when the solenoid 21 is deactivated, intensifier piston 31 is biased to a retracted position, as shown, within a piston bore 32 by a return spring 34. Intensifier piston 31 is connected to a plunger 37, which moves within a plunger bore 33, defined by a barrel 38, which is a portion of injector body 11. Intensifier piston 31 and plunger 37 move together between a retracted position, as shown, and an advanced position. Plunger 37 and a portion of plunger bore 33 define a fuel pressurization chamber 43 within which fuel is pressurized by the downward stroke of the plunger 37 during an injection event. Between injection events, plunger 37 draws fuel into fuel pressurization chamber 43 through a fuel inlet 14 from a fuel source 20, via a fuel passage 19 during its upward return stroke.

Barrel 38 also defines a spill passage 45. One end of spill passage 45 is a prime spill port 39, which opens into plunger bore 33 while the other end is a leak path 49 which opens into a low pressure area 57. Plunger 37 defines an annulus 41 and a set of internal axial passages 42. Together, annulus 41 and internal axial passages 42 create a spill path that will open fuel pressurization chamber 43 to spill passage 45 when annulus 41 is adjacent prime spill port 39. When plunger 37 is in the retracted position, annulus 41 is not open to prime spill port 39, and therefore fuel pressurization chamber 43 is closed to spill passage 45. It should be realized that the distance the plunger must travel before spill passage 45 opens corresponds to the first half of the split injection at an idle condition.

Fuel pressurization chamber 43 is fluidly connected to a nozzle chamber 51 by a nozzle supply passage 55. When plunger 37 begins its downward stroke, fuel within fuel pressurization chamber 43 is compressed and therefore the fuel pressure rises. Until fuel pressure within fuel pressurization chamber 43 is above a valve opening pressure, a needle valve member 52 prevents fuel flow into the combustion space by blocking the nozzle outlet 54. When fuel pressure within the fuel pressurization chamber 43 exceeds the valve opening pressure, needle valve member 52 is lifted against the action of a biasing spring 50, to open the nozzle outlet 54. The fuel within the fuel pressurization chamber 43 is then permitted to flow into nozzle chamber 51, via nozzle supply passage 55 and out of nozzle outlet 54 into the combustion space.

When annulus 41 on plunger 37 begins to advance into fluid communication with prime spill port 39, fuel within the fuel pressurization chamber 43 flows through the internal axial passages 42 and into a spill passage 45, via the prime spill port 39. Recall that with the Hafner fuel injector, when the annulus is adjacent the spill port, a relatively unrestricted flow path is created from the fuel pressurization chamber to a low pressure return area. Unlike the Hafner fuel injector, the present invention utilizes a plug 40 located in barrel 38 to prevent fuel from flowing through the prime spill port 39 directly into the low pressure area 57. In the present invention, a flow restriction is created between fuel pressurization chamber 43 and the low pressure area 57 by leak path 49. The geometric dimensions of leak path 49 strongly influence the fuel injector's split injection performance. For instance, if leak path 49 is too large, the spill flow will become relatively unrestricted and the fuel injector will perform like the Hafner fuel injector. However, if the leak path 49 is too small, little or no spillage will take place and it is likely that the present invention will perform like a typical hydraulically-actuated fuel injector without fuel spillage features. Further, dependent on the flow restriction created by leak path 49 when annulus 41 is open, pressure in the spill passage 45 is going to be substantially higher than pressure in the low pressure area 57.

In order to exploit the spill passage 45 pressure rise to increase dwell time, spill passage 45 is pressure coupled to a stop volume 56. The stop volume 56 is a substantially closed volume filled with fuel which has no direct connection to the low pressure area 57. The present invention exploits the stop volume 56 pressure to assist in pushing and holding the needle valve member 52 closed during the dwell time of the split injection event due to the pressure force acting on closing hydraulic surface 53. This is to be contrasted with the Hafner fuel injector, which utilizes a drop in fuel pressure within the fuel pressurization chamber to allow the needle valve member to close under the action of its biasing spring. One method of pressure coupling spill passage 45 to the stop volume 56 is by placing a moveable check piston 46 in fluid contact with both the stop volume 56 and the spill passage 45. An upper hydraulic surface 47 is exposed to pressure within the spill passage 45 while a lower hydraulic surface 48 is exposed to pressure in stop volume 56. Check piston 46 could also be sized to multiply the pressure force acting on its upper surface into an even higher pressure in stop volume 56. Alternatively, the closing hydraulic surface 53 of needle valve member 52 can be sized to produce a desired closing pressure force.

Figure 3:
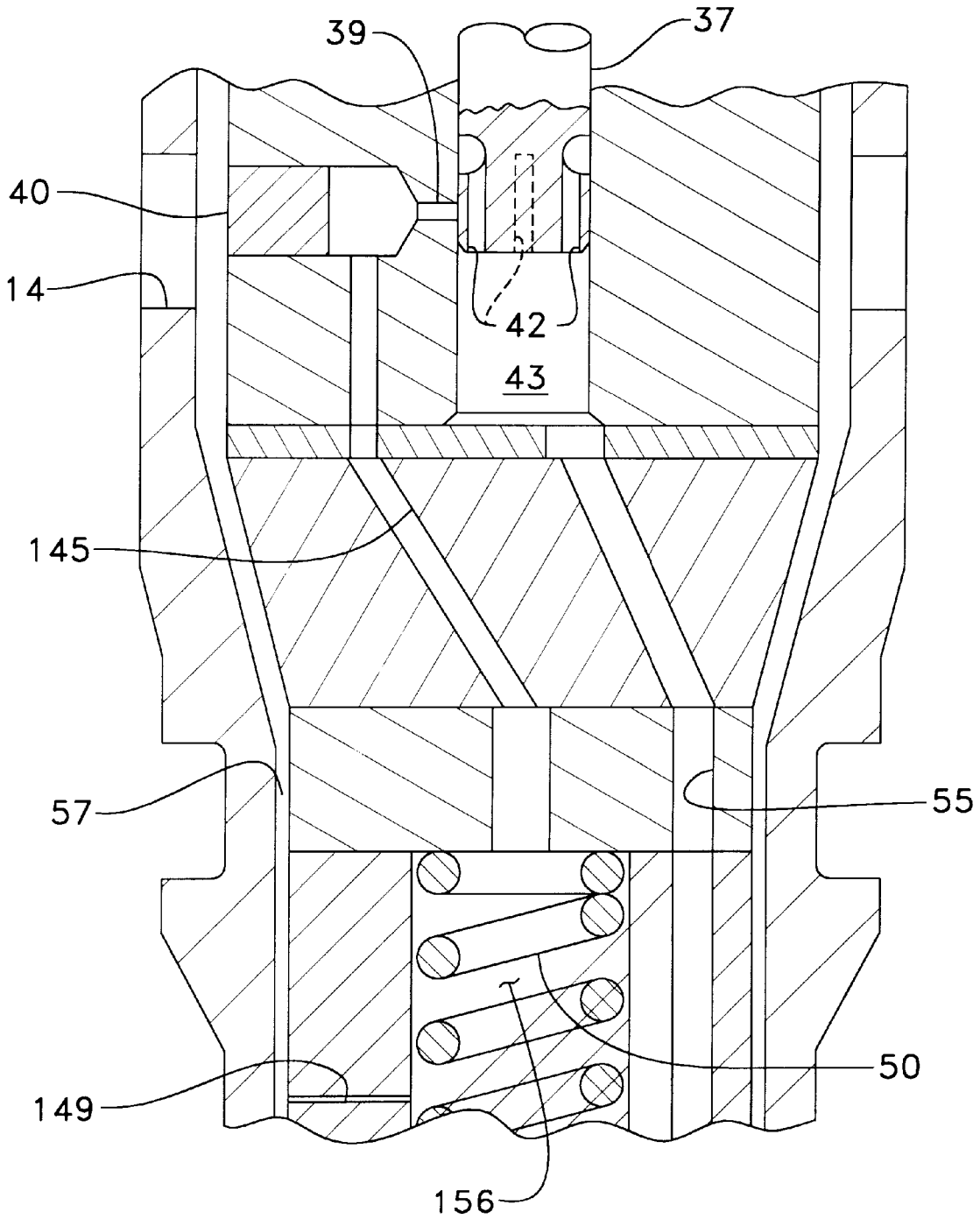
FIG. 3 is a partial diagrammatic side cross-section of the plunger portion of a hydraulically-actuated fuel injector according to another embodiment of the present invention.

Another method of creating the desired pressure coupling is shown in FIG. 3. In this embodiment, spill passage 145 is directly channeled through stop volume 156, thus creating the pressure coupling. Like the earlier embodiment, a small diameter leak path 149 connects spill passage 145 to low pressure area 57. In this embodiment, when annulus 41 opens fuel pressurization chamber 43 to spill passage 145, fuel pressure within spill passage 145 can act directly on the closing hydraulic surface 53 to push needle valve member 52 closed. In this embodiment, stop volume 156 is a portion of spill passage 145.

INDUSTRIAL APPLICABILITY

Referring again to FIGS. 1 and 2 and in addition to FIGS. 4*a–f*, prior to the start of an injection event, low pressure in the fuel pressurization chamber 43 prevails and the actuation fluid cavity 25 is open to the low pressure actuation fluid drain 13, the intensifier piston 31 and the plunger 37 are in their respective retracted positions, and the needle valve member 52 is in its closed position blocking the nozzle outlet 54. In addition, check piston 46 returns to its upward position between injection events. The injection event is initiated by activation of the solenoid 21. The activation of the solenoid 21 moves the control valve member 22 from high pressure seat 27 to low pressure seat 26, which opens the high pressure actuation fluid inlet 12. Actuation fluid can now flow into the actuation fluid cavity 25 from the source of high pressure actuation fluid 16, via the actuation fluid supply passage 15. High pressure actuation fluid entering the actuation fluid cavity 25 causes a rise in the pressure acting on intensifier piston 31.

Figure 4A:
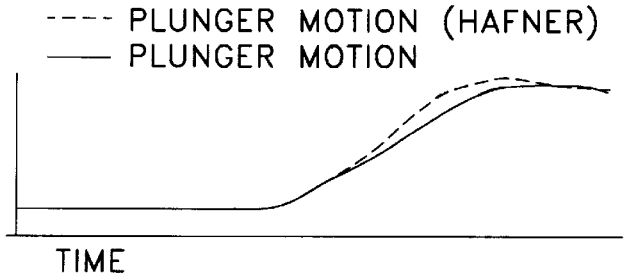
FIG. 4*a–f* are graphs of plunger motion, check piston motion, needle valve member motion, injection pressure, valve opening pressure, stop volume pressure, and injection rate versus time at an idle condition according to a fuel injector of the present invention and according to a Hafner fuel injector.
Figure 4B:
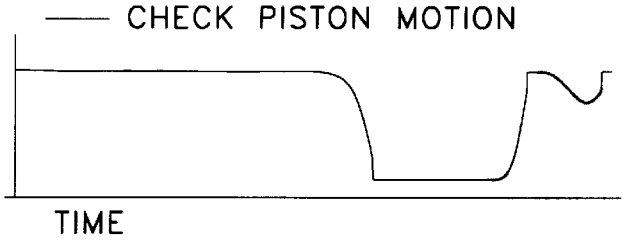
Figure 4C:
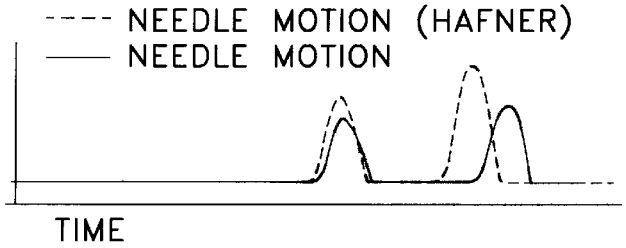
Figure 4D:
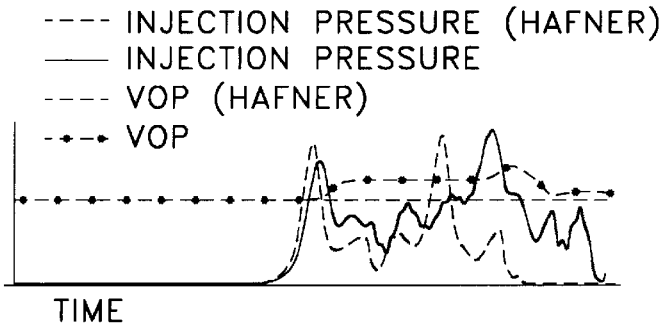
Figure 4E:
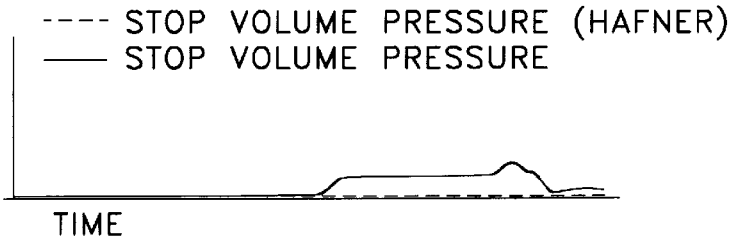
Figure 4F:
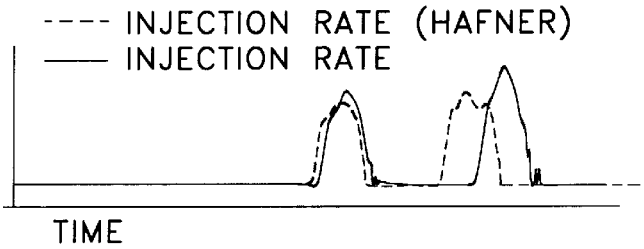

This rise in pressure acting on intensifier piston 31 begins to move the intensifier piston 31, and the plunger 37 from their retracted positions toward their downward advanced positions. The advancing movement of the plunger 37 causes a rise in pressure of the fuel within the fuel pressurization chamber 43 and the nozzle chamber 51. The increasing pressure of the fuel within the nozzle chamber 51 acts on the needle valve member 52, which is acting to close nozzle outlet 54. When the pressure exerted on the needle valve member 52 exceeds the valve opening pressure (FIG. 4*d*), needle valve member 52 is lifted against the action of the biasing spring 50, and fuel is allowed to spray into the combustion chamber from the nozzle outlet 54 (FIG. 4*f*).

As the injection event progresses, the plunger 37 continues moving from its retracted position toward its advanced position. As the plunger 37 advances, the annulus 41 opens to the prime spill port 39. The opening of annulus 41 to prime spill port 39 occurs where the plunger motion curves of Fig. 4*a* depart from one another. This aspect of the invention is explained by the fact that the plunger of the present invention moves slower than that of the Hafner plunger when the prime spill port 39 is open. Once annulus 41 opens to prime spill port 39, fuel from the fuel pressurization chamber 43 can spill through the prime spill port 39 and into the spill passage 45 via the internal axial passages 42 defined by the plunger 37. Because leak path 49 represents a flow restriction, pressure in spill passage 45 increases and the movement of plunger 37 slows relative to that of a Hafner injector (see FIG. 4*a*). This increase in pressure pushes piston 46 downward (FIG. 4*b*) compressing fuel within the stop volume 56 (FIG. 4*e*) which acts on the closing hydraulic surface 53 of needle valve member 52. In contrast, the pressure in the Hafner stop volume remains low throughout the injection event (FIG. 4*e*). The leak path 49 of the present invention should be sized so that there is a sufficient drop in pressure within the fuel pressurization chamber 43 and a sufficient pressure increase in the stop volume 56 that needle valve member 52 will move toward a closed position (see FIG. 4*c*). Recalling, the Hafner fuel injector relies only upon a pressure drop acting on the lifting hydraulic surface of the needle valve member to produce its split injection at idle conditions. Preferably, the needle valve member 52 of the present invention becomes pressure balanced when fuel spillage is occurring and is closed under the action of biasing spring 50. Various passageways and pressure surfaces should also be sized to hold needle valve member 52 closed while annulus 41 is open to spill passage 45. When needle valve member 52 closes, the first half of the split injection is ended.

Because of the pressure coupling created, needle valve member 52 cannot reopen until annulus 41 clears prime spill port 39. In the present invention, that cannot occur until a certain volume of fuel is displaced from fuel pressurization chamber 43. The volume of fuel that must be displaced is slightly less in the present invention than that of the Hafner fuel injector because the fuel is not an incompressible fluid. In other words, the higher spill pressures existing in the present invention cause the spilled fuel to become slightly compressed relative to low pressure spillage of the Hafner injector. The compression of the spilled fuel in the present invention has an additional bonus effect in that the energy used to compress the fuel is at least partially recovered later in the injection event, resulting in a more efficient operation for the overall fuel injector. In other words, less oil must be consumed by the fuel injector to inject an identical volume of fuel relative to a Hafner injector, which corresponds to an energy savings.

The rate of fuel displacement is dependent on the force acting on plunger 37 and the size of leak path 49. The increased dwell time produced by the present invention at idle condition relative to that of a Hafner fuel injector (see FIG. 4*f*) is partially attributed to the fact that the flow restriction of leak path 49 slows the spillage rate relative to that of the Hafner fuel injector. As annulus 41 closes, spillage ends and injection pressure begins to rise again. Pressure in spill passage 45 begins to decay through leak path 49 to equalize with the low pressure area 57. However, because pressure in the stop volume remains relatively high, the valve opening pressure of the needle valve member has increased causing the opening of the needle valve member to be further delayed (FIG. 4*d*). In other words, a portion of the increased dwell time of the present invention can also be attributed to the increased valve opening pressure due to the increased stop volume pressure acting on the closing hydraulic surface 53 of the needle valve member during and immediately after the spillage event. Thus, the increased dwell time at idle conditions according to the present invention can be attributed to the slowing of the spillage event and to an increased valve opening pressure at the end and shortly after the spillage event.

When fuel pressure within fuel pressurization chamber 43 rises above the now higher Valve Opening Pressure (see VOP in FIG. 4*d*). Needle valve member 52 reopens nozzle outlet 54 and the second half of the split injection commences. It should be noted that the pressure in the stop volume appears to peak in response to the opening of the needle valve member for the second half of the split injection event.

Shortly before the desired amount of fuel has been injected, a signal is sent to the solenoid 21 to end the injection event. Those skilled in the art will appreciate that a piezo electric crystal stack or other suitable electronic actuator could be substituted for the solenoid 21 shown in the illustrated embodiment without otherwise altering the performance of the illustrated fuel injector. When de-energized, Solenoid 21 allows the control valve member 22 to return to high pressure seat 27 under the action of biasing spring 24, closing high pressure actuation fluid inlet 12 and preventing further flow of high pressure actuation fluid from the source 16. When the control valve member 22 returns to the high pressure seat 27, the low pressure actuation fluid drain 13 is opened. This causes the pressure in the actuation fluid cavity 25 to drop, which stops the downward stroke of the intensifier piston 31 and the plunger 37. Because the plunger 37 is no longer moving downward, the pressure of the fuel within the fuel pressurization chamber 43 begins to drop. When this fuel pressure falls below the valve closing pressure, the needle valve member 52 returns to its downward position to close the nozzle outlet 54 and end the injection event.

The structure of the present invention is believed to provide two additional benefits over the Hafner injector toward the end of an injection event. First, as stated earlier, the present invention utilizes less energy to inject an identical amount of fuel, due at least in part to the fact that the energy used to compress the fuel during the spillage event is at least partially recovered during the last portion of the injection event. Secondly, because the present invention has substantially higher pressures in the stop volume toward the end of an injection event relative to that of the Hafner fuel injector, the needle valve member tends to move toward its closed position at a much faster rate causing a more desirable and more abrupt end to the second half of the injection event. This more abrupt ending is due to the increased pressure acting on closing hydraulic surface 53.

Between injection events various components of the injector body 11 begin to reset themselves in preparation for the next injection event. Because the pressure within the actuation fluid cavity 25 has dropped, the intensifier piston 31 and the plunger 37 return to their retracted positions under the action of return spring 34. The retracting movement of the intensifier piston 31 forces the actuation fluid from the actuation fluid cavity 25 into the drain reservoir 18 for recirculation. The retracting movement of the plunger 37 causes fuel from the fuel inlet 14 to be pulled into the fuel pressurization chamber 43 through the fuel passage 19, via an unseen passage.

Especially at idle conditions, the present invention alters the movement rate of intensifier piston 31 and plunger 37 for a portion of the split injection relative to the Hafner injector. (FIG. 4*a*). At the beginning of the injection event, prior to the opening of the spill passage 45, intensifier piston 31 and plunger 37 move at the same rate as a corresponding piston and plunger in the Hafner injector. When the spill passage is open in the Hafner injector, the piston and plunger move at a much faster rate. This is to be compared to the present invention, where the movement rate of intensifier piston 31 and plunger 37 is faster than when the spill passage 45 is closed, but slower than that of the Hafner injector. This is due to the flow restriction created in the present invention as opposed to the relatively unrestricted spill flow in the Hafner injector. Once annulus 41 closes spill passage 45, the movement rate of intensifier piston 31 and plunger 37 returns to the initial rate, and is once again about the same as that of the Hafner injector.

Figure 5A:
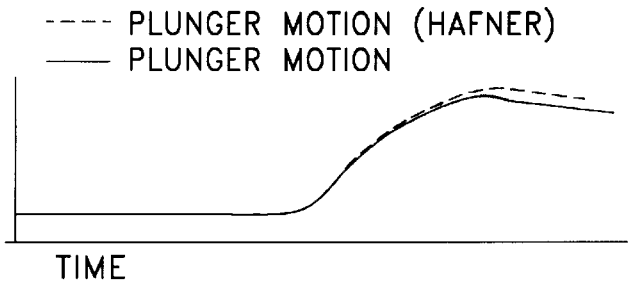
FIG. 5*a–f* are graphs of plunger motion, check piston motion, needle valve member motion, injection pressure, valve opening pressure, stop volume pressure, and injection rate versus time at a rated condition according to a fuel injector of the present invention and according to a Hafner fuel injector.
Figure 5B:
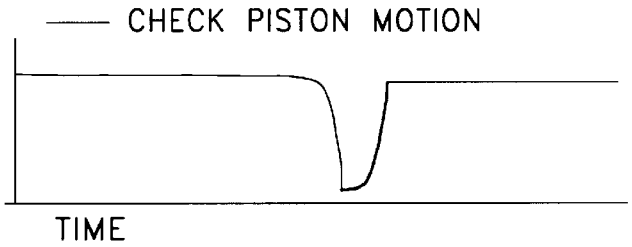
Figure 5C:
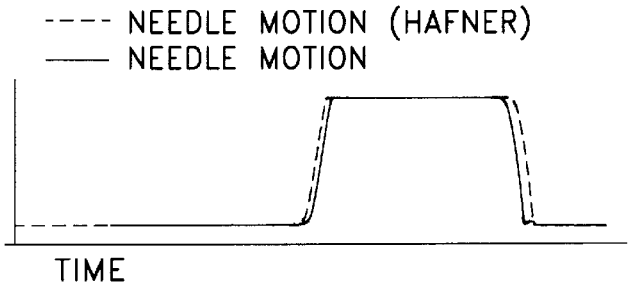
Figure 5D:
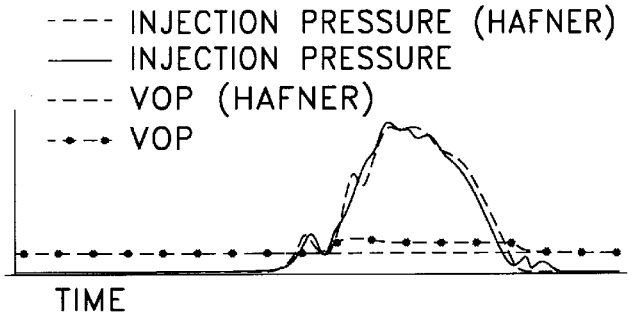
Figure 5E:
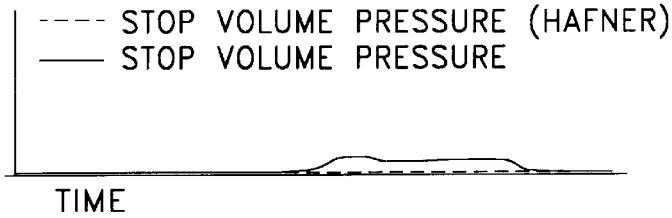
Figure 5F:
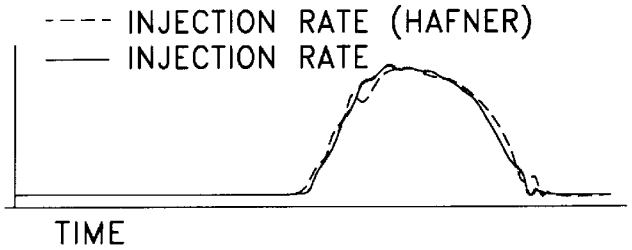

While the present invention and the Hafner injector perform differently to create split injections at idle engine operating conditions, both injectors perform similarly at rated operating conditions. (FIGS. 5*e–f*). That is to say that both methods leave engine performance unaffected at rated operating conditions. However, the present invention performs more efficiently and uses less energy at rated conditions relative to the Hafner injection because of the slowing of the plunger motion produced by the leak path flow restriction. At higher engine operating conditions, there is often a much higher rail pressure within the system. Therefore, intensifier piston 31 and plunger 37 move at a much faster speed. Plunger 37 moves so fast between the retracted and advanced positions that annulus 41 is open to spill passage 45 so briefly that no split injection can occur. (FIG. 5*f*). Likewise, with the Hafner injector, the plunger is moving so quickly that no split injection can occur. It should be noted, however, that the residual pressure in the stop volume of the present invention causes a much more abrupt ending to an injection event at rated conditions, which can result in improved emissions over an engine utilizing the Hafner fuel injector.

Those skilled in the art will appreciate that the present invention gives engineers the ability to greatly vary the possible dwell time at idle conditions relative to that of a Hafner injector. In other words, the dwell time for the Hafner injector at idle conditions can only be made so large without otherwise effecting the operation of the fuel injector at rated conditions. The present invention, on the other hand, is believed to be so flexible that it can broaden the range of potential dwell times at idle, and possibly even have the ability to produce split injections at operating conditions other than idle. Those skilled in the art will appreciate that by changing various features, including the size of the annulus, the size of the fuel spill port, the size of the leak path, the pressure ratio caused by the check piston 46 and possibly by sizing the closing hydraulic surface 53, different injection rate profiles at different conditions can be created.

It should be understood that the above description is intended only to illustrate the concepts of the present invention, and is not intended to in any way limit the potential scope of the present invention. Modifications could include, but are not limited to, variations on the size of the leak path or the manner in which spill passage is pressure coupled to the stop volume. Further, while the present invention has been illustrated for a hydraulically-actuated fuel injector, the concepts could be applied to virtually any fuel injector using a plunger to pressurize the fuel. Thus, various modifications could be made without departing from the intended spirit and scope of the invention as defined by the claims below.

What is claimed is:

1. A fuel injector comprising:

an injector body defining a fuel pressurization chamber, a spill passage, a low pressure area, a stop volume and a nozzle outlet;

a plunger positioned in said injector body and being movable a distance between a retracted position and an advanced position;

said plunger opening said spill passage to said fuel pressurization chamber over a portion of said distance;

a needle valve member with a closing hydraulic surface exposed to fluid pressure in said stop volume; and said stop volume being pressure coupled to said spill passage at a location away from said low pressure area.

2. The fuel injector of claim 1 wherein a portion of said spill passage is a leak path that opens to said low pressure area.

3. The fuel injector of claim 2 wherein said plunger defines a spill path that opens said fuel pressurization chamber to said spill passage over said portion of said distance; and said leak path having a restrictive flow area relative to said spill path.

4. The fuel injector of claim 1 wherein said stop volume is pressure coupled to said spill passage by a movable piston with an upper hydraulic surface exposed to fluid pressure in said spill passage and a lower hydraulic surface exposed to fluid pressure in said stop volume.

5. The fuel injector of claim 1 wherein said stop volume is pressure coupled to said spill passage by a pressure communication passage extending between said spill passage and said stop volume.

6. The fuel injector of claim 1 wherein said portion of said distance is a relatively small fraction of said distance located between an initial portion and a remaining portion.

7. A fuel injector comprising:

an injector body defining a fuel pressurization chamber, a low pressure area, a spill passage, a stop volume and a nozzle outlet;

a plunger positioned in said injector body and being movable a distance between a retracted position and an advanced position;

said plunger opening said spill passage to said fuel pressurization chamber over a portion of said distance, but closing said spill passage to said fuel pressurization chamber when said plunger is in said retracted position and said advanced position;

a needle valve member with a closing hydraulic surface exposed to fluid pressure in said stop volume; and said stop volume being pressure coupled to said spill passage upstream from said low pressure area, and a portion of said spill passage being a leak path that opens to said low pressure area.

8. The fuel injector of claim 7 wherein said plunger defines a spill path that opens said fuel pressurization chamber to said spill passage over said portion of said distance; and said leak path having a restrictive flow area relative to said spill path.

9. The fuel injector of claim 8 wherein said leak path is sufficiently restrictive to flow that fluid pressure assists in moving said needle valve member to said closed position when said fuel injector is operating at a small injection condition and said fuel pressurization chamber is open to said spill passage.

10. The fuel injector of claim 9 wherein said spill passage is open to said fuel pressurization chamber so briefly when said fuel injector is operating at a large injection condition that said needle valve member remains in an open condition.

11. The fuel injector of claim 10 further comprising a spring operably positioned to bias said needle valve member toward said closed position; and said needle valve member including at least one lifting hydraulic surface exposed to fluid pressure in said fuel pressurization chamber.

12. The fuel injector of claim 11 wherein said stop volume is pressure coupled to said spill passage by a movable piston with an upper hydraulic surface exposed to fluid pressure in said spill passage and a lower hydraulic surface exposed to fluid pressure in said stop volume.

13. The fuel injector of claim 11 wherein said stop volume is pressure coupled to said spill passage by a pressure communication passage extending between said spill passage and said stop volume.

14. A hydraulically actuated fuel injector comprising:

an injector body defining a fuel pressurization chamber, a low pressure area, a spill passage, a stop volume and a nozzle outlet;

an intensifier piston positioned in said injector body and being hydraulically movable from a retracted position toward an advanced position;

a plunger operably connected to said intensifier piston in said injector body and being movable a distance between said retracted position and said advanced position, and said plunger defining an annulus that opens said spill passage to said fuel pressurization chamber over a portion of said distance, but closing said spill passage to said fuel pressurization chamber when said plunger is in said retracted position and said advanced position;

a needle valve member with a closing hydraulic surface exposed to fluid pressure in said stop volume; and said stop volume being pressure coupled to said spill passage upstream from said low pressure area, and a portion of said spill passage being a leak path that opens to said low pressure area.

15. The hydraulically actuated fuel injector of claim 14 further comprising a spring operably positioned in said injector body to bias said needle valve member toward said closed position.

16. The hydraulically actuated fuel injector of claim 15 wherein said leak path is sufficiently restrictive to flow that fluid pressure in said stop volume assists in moving said needle valve member to said closed position when said fuel injector is operating at a small injection condition and said fuel pressurization chamber is open to said spill passage.

17. The hydraulically actuated fuel injector of claim 16 wherein said spill passage is open to said fuel pressurization chamber so briefly when said fuel injector is operating at a large injection condition that said needle valve member remains in an open condition.

18. The hydraulically actuated fuel injector of claim 17 wherein said stop volume is pressure coupled to said spill passage by a movable piston with an upper hydraulic surface exposed to fluid pressure in said spill passage and a lower hydraulic surface exposed to fluid pressure in said stop volume.

19. The hydraulically actuated fuel injector of claim 17 wherein said stop volume is pressure coupled to said spill passage by a pressure communication passage extending between said spill passage and said stop volume.

20. The hydraulically actuated fuel injector of claim 17 wherein said injector body defines a fuel inlet connected to a source of fuel fluid, and an actuation fluid inlet connected to a source of actuation fluid that is different from said fuel fluid.

* * * * *